US008181394B2

(12) United States Patent
Michaels

(10) Patent No.: US 8,181,394 B2
(45) Date of Patent: May 22, 2012

(54) REINFORCED ELEVATOR DOOR GUIDE

(76) Inventor: Donald Charles Michaels, Old Bridge, NJ (US)

( * ) Notice: Subject to any disclaimer, the term of this patent is extended or adjusted under 35 U.S.C. 154(b) by 1056 days.

(21) Appl. No.: 12/150,802

(22) Filed: May 1, 2008

(65) Prior Publication Data

US 2008/0271960 A1 Nov. 6, 2008

Related U.S. Application Data

(60) Provisional application No. 60/927,346, filed on May 3, 2007.

(51) Int. Cl.
*E05D 15/06* (2006.01)

(52) U.S. Cl. ..... 49/409; 49/410; 49/411

(58) Field of Classification Search ..... 49/409, 49/410, 411

See application file for complete search history.

(56) References Cited

U.S. PATENT DOCUMENTS

| | | | | |
|---|---|---|---|---|
| 1,083,963 | A | | 1/1914 | Voight |
| 1,985,298 | A | | 12/1934 | Prince |
| 2,013,269 | A | | 9/1935 | Ginsburg |
| 2,015,270 | A | | 9/1935 | Henry |
| 2,142,519 | A | * | 1/1939 | Loftis ..... 16/90 |
| 2,217,489 | A | | 10/1940 | McCormick |
| 2,772,596 | A | * | 12/1956 | Trussell ..... 411/535 |
| 3,195,171 | A | * | 7/1965 | Klein ..... 16/90 |
| 3,523,390 | A | | 8/1970 | McAuley, Jr. |
| 5,174,675 | A | | 12/1992 | Martin |
| 5,584,142 | A | * | 12/1996 | Spiess ..... 49/411 |
| 5,706,913 | A | | 1/1998 | Rivera |
| 6,684,573 | B2 | | 2/2004 | Heath et al. |
| 6,988,592 | B2 | | 1/2006 | Watabe et al. |
| 7,143,870 | B2 | | 12/2006 | Watabe et al. |
| 2002/0139621 | A1 | | 10/2002 | Watabe et al. |
| 2005/0023425 | A1 | | 2/2005 | Jackson |
| 2006/0075708 | A1 | | 4/2006 | Watabe et al. |
| 2006/0191749 | A1 | | 8/2006 | Sasaki et al. |
| 2006/0243535 | A1 | | 11/2006 | Kinoshita et al. |
| 2007/0295564 | A1 | | 12/2007 | Someya |

FOREIGN PATENT DOCUMENTS

| | | | |
|---|---|---|---|
| EP | 0 455 973 | A1 | 3/1991 |
| EP | 0 455 973 | B1 | 3/1991 |
| JP | 52 061070 | | 5/1977 |
| JP | 04 226294 | | 8/1992 |
| JP | 06-072678 | | 3/1994 |
| JP | 06072678 | A * | 3/1994 |

OTHER PUBLICATIONS

PCT Written Opinion, Oct. 29, 2008, Donald Charles Michaels.
PCT Int'l Search Report, Oct. 29, 2008, Donald Charles Michaels.
IB Patentability Report, Nov. 12, 2009, Donald Charles Michaels.

* cited by examiner

*Primary Examiner* — Katherine W Mitchell
*Assistant Examiner* — Clearence W Mayott, III
(74) *Attorney, Agent, or Firm* — Gearhart Law, LLC

(57) ABSTRACT

This invention claims a steel elevator door guide, which contains a reinforcement beam, an attachment beam, a guide carrier and a glide. The attachment beam connects at the bottom end of a elevator cab or corridor door. The invention is held securely clamped together by fasteners, welding or glue. To further protect against any lateral movement imposed onto an elevator door, one or more frictional surfaces is engraved at contact points between individual components and safety rail(s) are provided. A noise reducing, nylon glide is attached to the guide carrier using the same fasteners as those supporting the reinforcement beam. These components are intended to prevent lateral motion of an elevator cab or corridor door even if a severe lateral pressure on the elevator doors has caused the glide to severely flex or fail.

11 Claims, 4 Drawing Sheets

REINFORCED ELEVATOR DOOR GUIDE

PRIORITY

This application claims the priority of U.S. Ser. No. 60/927,346 filed on May 3, 2007, which is incorporated herein by reference.

FIELD OF THE INVENTION

The present invention relates to slide type elevator doors, and more particularly to guide assemblies for such doors.

BACKGROUND OF THE INVENTION

The present invention describes a new and improved elevator door guide, which guides the doors of an elevator cab, or the corridor doors that open at each floor served by the elevator, along a groove found in the sill of the door opening.

An elevator system is comprised of a vertical shaft and an elevator cab that moves up and down the shaft as it transports people and things between floors. An elevator contains door (s) for the elevator cab and door (s) located at each floor served by the elevator known as corridor doors. The method of installing both cab and corridor doors is similar. Generally, door sills are provided at the respective door opening on which struts are mounted. These struts support "headers". In turn, the headers support the door hanger tracks/rails on which the entrance door panels are hung, thus bearing the bulk of the weight of the door (s). The bottom of the door (s) is then guided by the use of door guides which ride in the groove of the door sill, with the elevator door guide secured to the door at the bottom.

An elevator door guide does not usually come in contact with bottom of the groove in the door sill, but uses the sides of the groove to keep the door moving longitudinally along the groove, as the doors open and close.

Although lateral movement of the door is required for the removability of the doors for maintenance, it creates an undesirable risk of the door suddenly swinging inwardly during its normal elevator operation due to lateral forces imposed onto the door, thus causing a serious risk of injury or death when a person falls into the elevator shaft. Accidents have been known to happen where the elevator door guide disintegrates, or otherwise fail due to loads imposed on them from people leaning on doors, running into doors or even from wheel chairs hitting doors. Since the guide is hidden from view and is not needed to keep a door hanging in its place, an onlooker is unaware that the guide may be missing or has been compromised and may lean on the elevator doors. Without a guide, the door will swing into the elevator shaft, causing a person who leaned on them to fall to his or her detriment or death. A compromised guide could lead to the same result.

Although elevator door guides are well known, nothing in the prior art addresses this safety risk adequately. Prior inventions deal with innovative ways of how an elevator door can be guided longitudinally within a groove, but fail to provide any back-up components or strength members to ensure that the door would not swing freely into the elevator shaft if the guide is compromised.

For example, U.S. Pat. No. 5,174,675 (1992) to Martin discloses a guide that has only several screws keeping it in place. The guide is not made of metal and thus can fail under strong lateral pressure. The safety tabs designed to keep the door from swinging inwardly do not achieve the desired protection. First, these tabs are above the edge of the groove and assume that the guide will disintegrate, causing the door to sink into the groove. This may happen in case of a fire, which is the main focus of '675 patent. However, in most cases the guide failed due to the lateral pressure exerted on the doors, for example by those leaning or running into the doors. A failure of this kind may keep the guide in place, but will make it cracked or bent. This creates a situation where the safety tabs have not yet engaged the groove, when the guide is already decisively compromised.

Similarly, a U.S. Pat. No. 5,706,913 to Rivera (1998) discloses another type of guide. This one is a narrow metal sliver that guides the doors along a groove located within the outer edge of the door sill. Nothing is reinforcing this sliver of a guide against a potential failure.

On the other hand, the present invention adds improved safety features which are highly desirable and much needed in the industry.

SUMMARY OF THE INVENTION

The invention is an elevator door guide having an attachment beam, suitable for attaching the elevator guide to an elevator door, the attachment beam having a top surface and a bottom surface, a reinforcing beam attached to the top surface of the attachment beam, and a guide carrier attached to the bottom surface of the attachment beam, wherein the guide carrier can be movably located within an elevator door track.

It is an objective of this invention to provide a new and useful improvement on an elevator door guide. The improved door guide is stronger and safer than door guides present in the prior art. The guide in this invention contains all metal components in locations that are most likely to experience lateral, inward pressure. The non-metal glide components are intended to be used during elevator's normal operation, whereas the metal components help withstand significant lateral pressure on the doors and keep them from swinging inward into an elevator shaft.

Another objective of this invention is to provide a more robust elevator guide by using a combination of fasteners, female connectors, pins and serrations to keep an elevator guide firmly and securely clamped together.

Yet another objective of the invention is to provide a smooth and quiet operation of the elevator doors, by employing noise reducing materials for the glide component of the invention.

DESCRIPTION OF THE PREFERRED EMBODIMENTS

Figure 1:
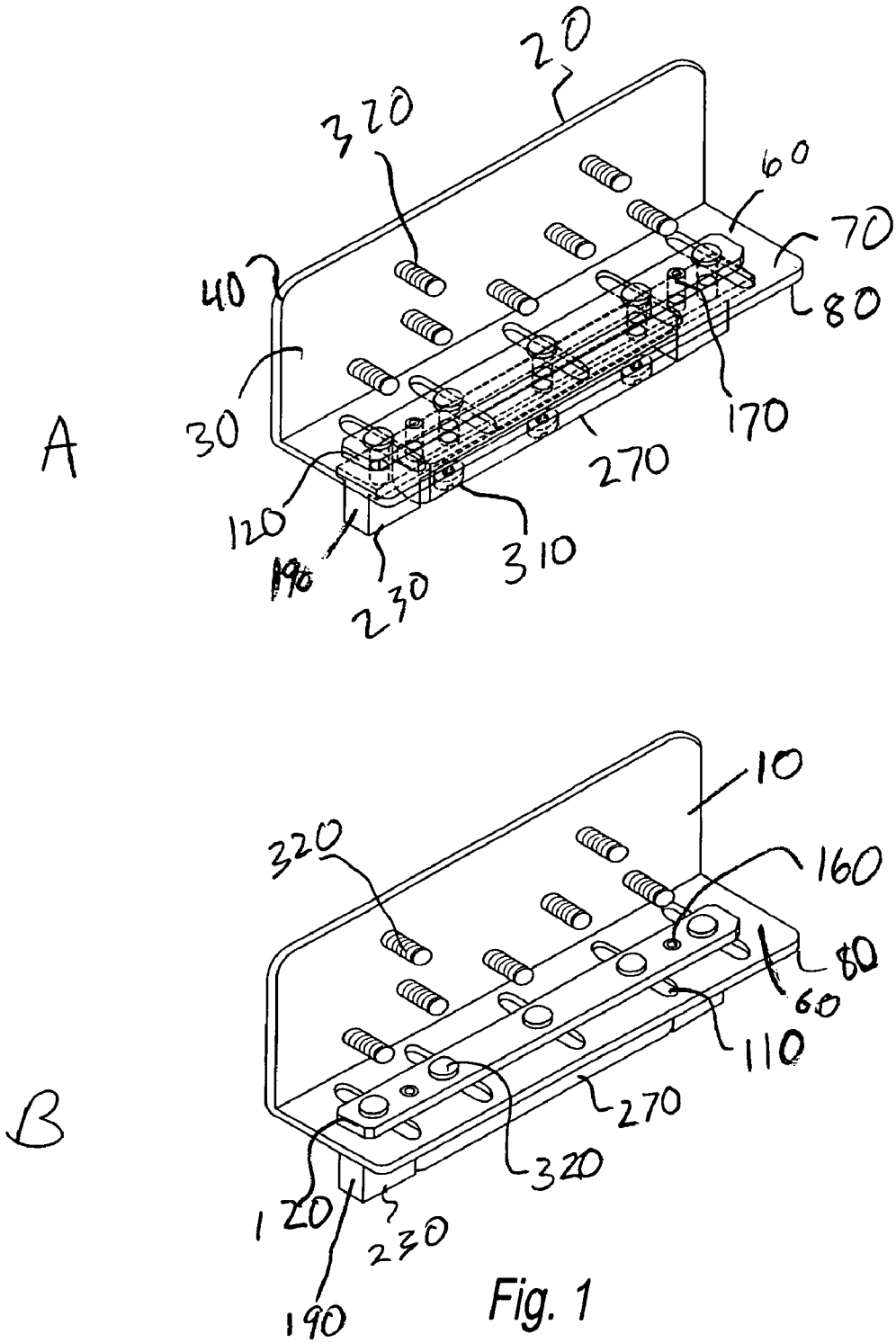
FIG. 1 is a perspective view of a preferred embodiment of the invention, showing an L-shaped beam with fasteners firmly clamping the reinforcing beam and the guide to the horizontal piece of the L-shaped beam.

The preferred embodiments of the present invention will now be described with reference to FIG. 1-7 of the drawings. Identical elements in the various figures are identified with the same reference numerals.

Referring to FIG. 1, the present invention is directed to improvements of an elevator door guide. FIGS. 1A and 1B illustrate a fully assembled perspective view of the invention. The invention has an attachment beam 10, a guide carrier 190, and a reinforcement beam 120. The attachment beam 10 allows the invention to be attached to the elevator door, and is preferably L-shaped as shown in the figures. However, attachment beam 10 can also be U-shaped, J-shaped, or I-shaped, or a flat planar shape, or any other shape suitable for attaching guide carrier 190. In the preferred embodiment, attachment beam 10 is L-shaped and has vertical piece 20 and horizontal piece 60. The attachment beam 10 is made preferably out of a heavy metal, such as steel, but can also be made of lighter alloys, such as aluminum or other materials such as plastic, including a variety of ferrous and non-ferrous materials, such as carbon fiber, cast iron, stainless steel, fiberglass, etc.

Figure 4:
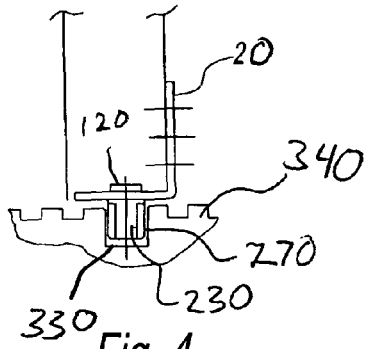
FIG. 4 is a side view of the invention displaying the L-shaped beam connected to a door of an elevator, with the guide part of the invention ensconced within a groove of a door sill.
Figure 7:
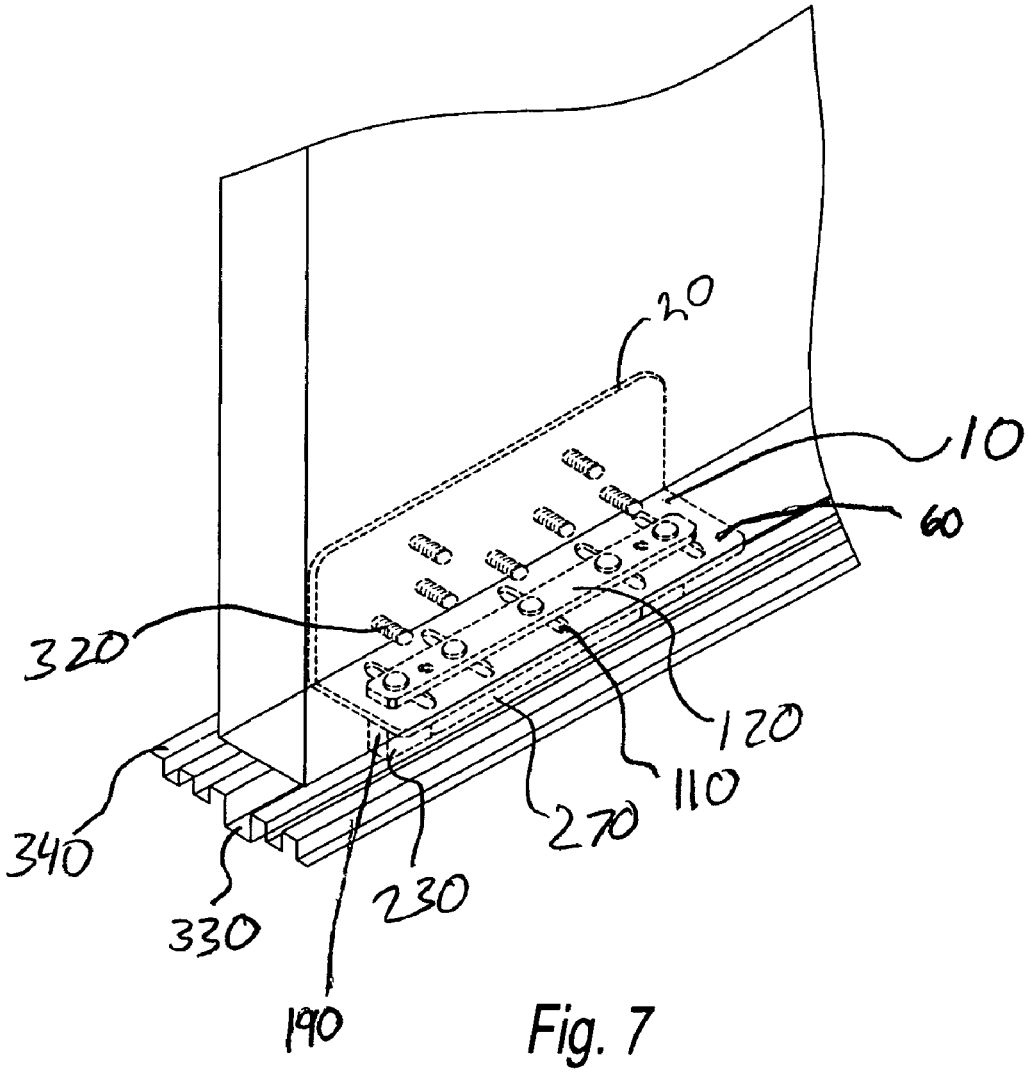
FIG. 7 is a perspective view of the preferred embodiment of the invention showing the door guide's assembly, its attachment to an elevator door, and its position within the groove of the elevator door sill.

The vertical piece 20 of the attachment beam 10 (numbered in FIG. 2) is mounted to elevator cab doors or the corridor doors of an elevator (not shown), with fasteners 320. Attachment beam 10 may also be attached to the door via welding or gluing, instead of fasteners 320. The vertical piece can either be attached to the outer surface of an elevator door, where it will be visible to the one ridding the elevator, but is preferably mounted invisibly between the outer surfaces of said door. The horizontal piece 60 resides above the sill 340 of an elevator door opening (FIGS. 4, 7).

Still referring to FIG. 1, a reinforcing beam 120 may also be placed on the top surface 70 of the horizontal piece 60 to add additional reinforcement. Fasteners 320 are shown in an inserted position, running through the reinforcing beam 120, the positioning slots 110 of the attachment beam 10, and terminating in the guide carrier 190. In the preferred embodiment, the reinforcement beam 120 is made of steel, but may also be made of a lighter metal alloy, such as aluminum or other materials such as plastic, including a variety of ferrous and non-ferrous materials, such as carbon fiber, cast iron, stainless steel, fiberglass, etc. The reinforcement beam 120 is preferably attached to the attachment beam 10 and the guide carrier 190 with fasteners 320 and at least one positioning pin 170.

Figure 2:
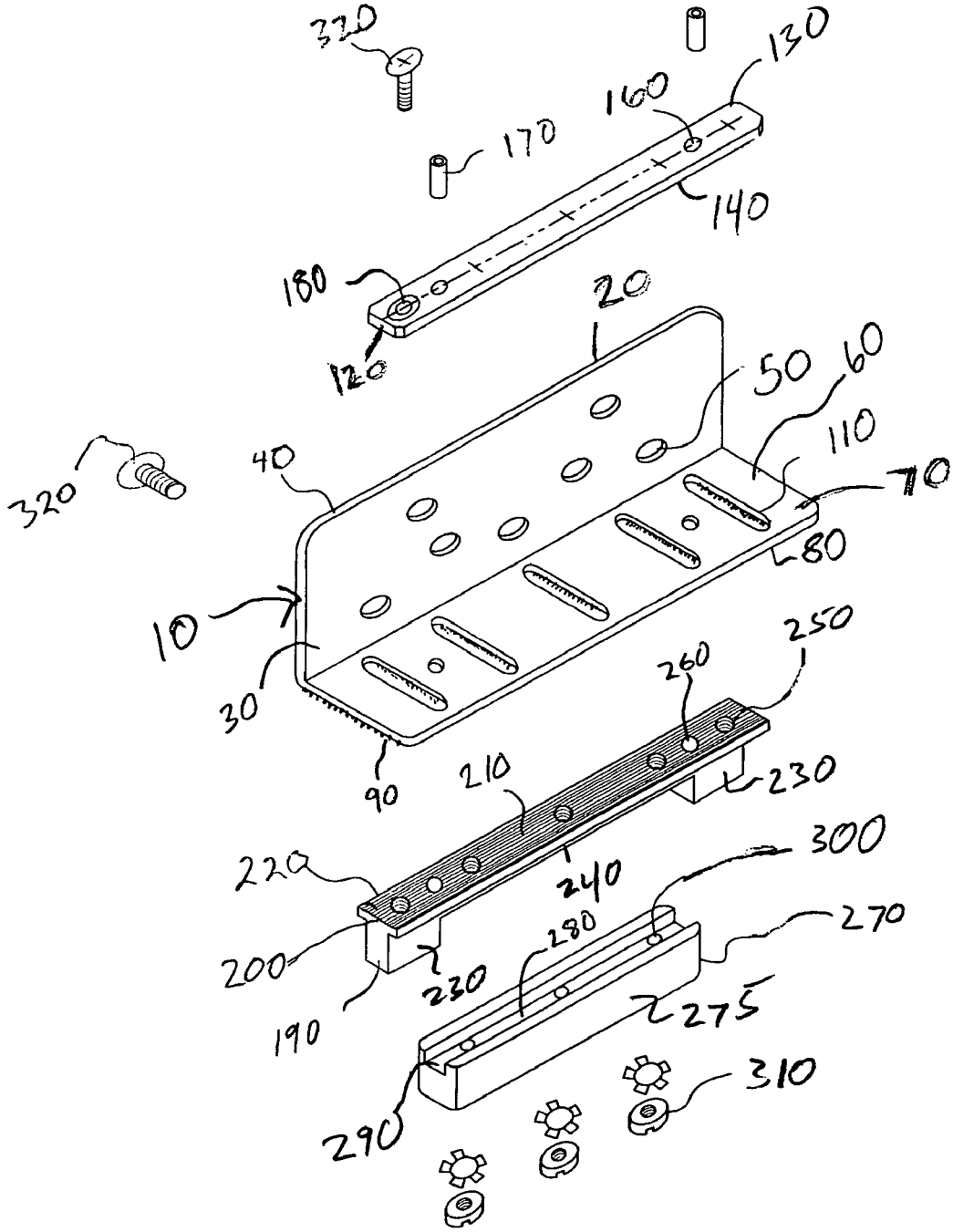
FIG. 2 is an exploded perspective view of the various components of the invention.

On the horizontal piece 60 of the attachment beam 10, the fasteners 320 are inserted through the positioning slots 110. The positioning slots 110, run across the width of the horizontal piece 60 and are used to adjust the position of the guide carrier 190 with respect to the groove 330 of the door sill 340 (FIGS. 4 & 7). The glide 270 is preferably made out of nylon and mounted between the safety rails 230 (FIGS. 1 & 2). The safety rail 230 can be placed between multiple sections of the glide 270. In another embodiment, safety rail 230 extends the full length of the guide carrier 190 wherein a separate glide 270 would be absent. Safety rail 230 could also be coated or covered with a replaceable or non-replaceable nylon cover or other coating that would reduce friction and noise. The safety rail 230 and the glide 270 can be positioned in multiple configurations with respect to each other. Thus, the guide carrier 190 could have any number or combinations of safety rails 230 and glides 270, preferably alternating, and of the same or differing lengths.

FIG. 2 is an exploded, perspective diagram of individual components of the reinforced elevator door guide. Shown is the attachment beam 10, comprised of a vertical piece 20 and a horizontal piece 60. The vertical piece 20 contains a front surface 30, a back surface 40, and mounting holes 50. The mounting holes 50 are used for fasteners 320. The mounting holes 50 and fasteners 320 can be replaced by welding or gluing the invention to an elevator door.

Still referring to FIG. 2, horizontal piece 60 is further comprised of a top surface 70, a bottom surface 80, and preferably, a frictional surface 90. Horizontal piece 60 also preferably has a plurality of positioning slots 110, and preferably at least one positioning pin 170. The attachment beam 10 may consist of just the horizontal piece 60, which would then be attached or glued to the bottom of an elevator door. The frictional surface 90 may be disposed onto the top surface 70 or the bottom surface 80. However, the preference is for the frictional surface 90 to be present on the bottom surface 80.

The frictional surface 90 is preferably serrated. These serrations are evenly spaced grooves running lengthwise for the entire length of the horizontal piece 60. The serrations are present in a trough like pattern ensuring a positive interlocking surface. While serrations are preferred, as used herein, the term "frictional surface" can also mean a knurled pattern, sanded or sand blasted surface, ridges, etc. It could also be a rubber gasket, epoxy glue or other median. The purpose of the frictional surface 90 is to decrease the chance that the individual components of the elevator guide will slip lateral or become loose when force is applied to a door.

Still referring to FIG. 2, the positioning slots 110 run perpendicular to the length of the horizontal piece 60. Their main purpose is to allow an installer to adjust the location of the guide carrier 190, with respect to the door sill groove 330 (FIGS. 4, 7) by moving the carrier guide 190 laterally, perpendicular to the direction of the door sill groove 330. It is preferred that the opposite edges of the positioning slots 110 run in a straight line.

To further decrease the chance that the individual components of the elevator door guide will slip laterally or become loose when forced is applied to a door, the preferred embodiment calls for at least one positioning hole 160 for a positioning pin 170. The positing holes 160 can be drilled through once the reinforcing beam 120 and the guide carrier 190 are securely attached to the top and bottom surface respectively, of the horizontal piece 60.

The reinforcing beam 120 in FIG. 2, is comprised of a top surface 130, a bottom surface 140, a plurality of mounting holes 180 for fasteners 320, and preferably at least one positioning hole 160 for a positioning pin 170. Additionally, the bottom surface 140 may contain a frictional surface similar to the frictional surface 90 located on the horizontal piece 60. The mounting holes 180 correspond to the positioning slots 110 of the horizontal piece 60 and are used to for inserting fasteners 320 to bind individual elevator door guide components together. The positioning pins 170 can be used to further prevent lateral movement of guide carrier 190 and reinforcing beam 120 relative to attachment beam 10, when force is applied to the elevator door. A series of elongated washers can be used instead of a reinforcing beam 120. While preferred, the reinforcing beam 120 can be eliminated altogether. In this case, fasteners would be inserted directly into the positioning slots 110 of the horizontal piece 60. For in another embodiment, top flange 200 of the guide carrier 190 is wide, thus enhancing the clamping force by spreading it over a wider area.

Still referring to FIG. 2 the guide carrier 190 is preferably comprised of a top flange 200, a top surface 210, a bottom surface 220, at least one safety rail 230, a horizontal beam 240, a plurality of mounting holes 250, at least one positioning hole 260, and a glide 270. The guide carrier 190 can also be a solid beam, preferably comprised of a top flange 200. The guide carrier 190 is diagramed having a T-shape, but can be bar shaped or L shaped (if the top flange 200 overhangs on one side only) or any other shape. The guide carrier 190 is made out of steel or lighter alloys, such as aluminum or other materials such as plastic, including a variety of ferrous and non-ferrous materials, such as carbon fiber, cast iron, stainless steel, fiberglass, etc. The main function of the guide carrier 190 is to serve as shatter resistant reinforcement member of the elevator door guide, i.e. to prevent lateral motion by an elevator door when force is applied to it. Thus, materials must be strong enough to fulfill this function. The guide carrier 190 is intended to slide along the door sill grove 330 (FIGS. 4, 7) without making contact.

The top flange 200 of the guide carrier 190 is positioned horizontally with respect to the bottom surface 80 of the horizontal piece 60, and may contain a frictional surface similar to the frictional surface 90 described for horizontal piece 60. The top flange 200 contains a plurality of mounting holes 250 (for fasteners 320) that align with the positioning slots 110 of the horizontal piece 60, and are therefore also align with the mounting holes 180 of the reinforcing beam 120. The top flange 200 may also contain at least one positioning pin hole 260 for a positioning pin 170. The positioning pins 170 may be added to the top flange 200 once an elevator door guide assembly is complete, by drilling a hole through the reinforcing beam 120, attachment beam 10, and into the guide carrier 190. A positioning pin 170 may be placed in the hole. Alternatively the hole may be tapped, and a screw inserted therein.

FIG. 2 also illustrates the glide 270, which contains a glide sidewall 275, a glide top 280, a glide groove 290, a plurality of glide mounting holes 300, and a plurality of female connectors 310. The glide 270 is preferably made out of nylon, but can also be made out of polypropylene, plastics, rubber, leather or wood. Ball bearings could also be used. The glide grove 290 connects to the horizontal beam 240 of the safety rail 230, while the glide top 280 may rest against the bottom surface 220 of the guide carrier 190. The sidewall 275 may be flush with the overhang of the top flange 200, or it can be wider or narrower than the top flange 200. The glide mounting holes 300 are within the glide groove 290 and are intended to receive the fasteners 320 as it is inserted from the reinforcement beam 120 through the attachment beam 10 down through the guide carrier 190 towards the glide 270. The female connectors 310 are recessed at the bottom of the glide 270, at the terminal end of the glide mounting holes 300 and serve as the terminating point for the fasteners 320. The fasteners 320 can instead be inserted from the bottom of the glide 270, using the glide holes 300, and up through the guide carrier 190, into the attachment beam 10, and be terminated with female connectors 310 that reside either on the top surface 70 of the attachment beam 10, or on top surface 130 of the reinforcement beam 120.

The glide 270, and the safety rail(s) 230 of the guide carrier 190 reside within the door sill groove 330 (FIGS. 4, 7) and guide elevator cab or corridor doors longitudinally back and forth along the door sill grove 330. Alternatively, the safety rail (s) can be located in the center with the glide located to either or both sides of the safety rail (s). Yet another alternative is to eliminate the glide 270 completely and to use one solid safety rail 230 instead. The glide 270 is wider than the safety rail 230 and is intended to slide against the sides of the door sill grove 330 (FIG. 4, 7) as the doors open and close. The glide 270 is yet another member of this invention that serves to prevent lateral movement by an elevator door, which is an undesirable safety risk.

Figure 3:
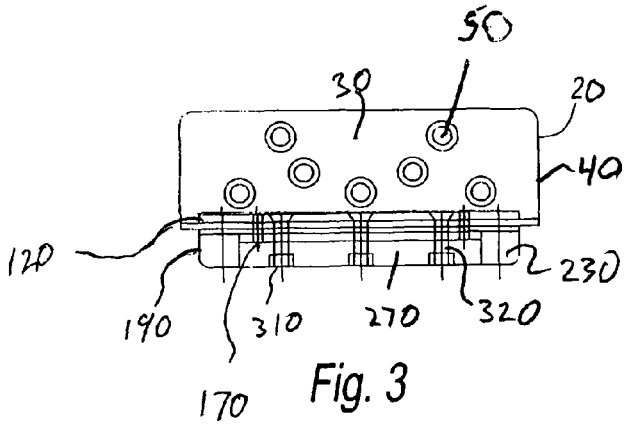
FIG. 3 is a front, lengthwise view of the preferred embodiment showing the front surface of the vertical piece, the heads of the fasteners, and the transparent view of the guide.

FIG. 3 shows the elevator door guide from the front view. Shown are the vertical piece 20, a front surface 30, a back surface 40, a plurality of mounting holes 50 for fasteners 320, and at least one positioning pin 170. Also shown in FIG. 3 is a drawing of the guide carrier 190 along its length. The fasteners 320 are inserted into the mounting holes 50 from the back surface 40 toward the front surface 30. This drawing illustrates that the glide 270 is located between the guide safety rail (s) 230 and contains recessed areas for the female connectors 310. As shown, the fasteners 320 are inserted into the reinforcement beam 120 and run through the entire elevator door guide assembly, to terminate within the safety rails 230 and within the female connectors 310. Mounting pins 170 serve as back-up connectors to the fasteners 320, in case the latter get loose during elevator's continuous operation. Welding can serve as an alternative to positioning pins 170.

FIG. 4 describes the elevator door guide with respect to the door sill grove 330. Illustrated are a side view of the attachment beam 10, a reinforcement beam 120, a safety rail 230, a glide 270, a door sill groove 330 and a door sill 340. The safety rail 230 is visible in the foreground, while the glide 270 is visible in the background, behind the safety rail 230. The glide 270 is wider than the safety rails 230 to minimize undesirable noise which would be emitted if the metallic safety rails 230 were to slide against the metallic door sill groove 330. The glide 270 also prevents wearing out of the door sill groove. Yet, since the rigid safety rails 230 are still present within the door sill groove 330 rather than the weaker, more flexible glide 270 being present alone within the said groove 330, prevention of lateral movement by an elevator door is not diminished. Thus, safety is not compromised.

Figure 5:
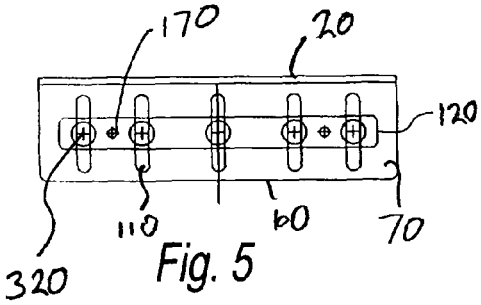
FIG. 5 is a top view of a preferred embodiment of the invention.
Figure 6:
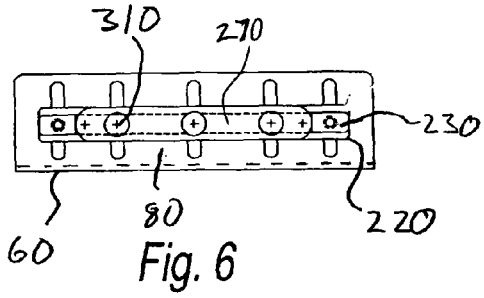
FIG. 6 is a bottom view of a preferred embodiment of the invention, showing an L-shaped beam, the glide and the safety rail (s).

FIGS. 5 and 6 are the top and bottom views, respectively, of the horizontal piece 60 of the attachment beam 10.

Finally FIG. 7 illustrates how an elevator door guide is mounted to a cab or corridor door and how it provides longitudinal motion along the door sill groove sill 330. Note that this is a transparent, perspective drawing. In reality the entire assembly or at least the horizontal piece is beneath the elevator door and is not visible to an elevator user.

This invention provides vast safety improvements over prior art by providing improved clamping strength between the parts of the elevator door guide and by decreasing the likelihood of lateral motion due to the failure of the glide. All components are attached to each other in a way that promotes clamping strength and prevents lateral slippage, perpendicular to the motion of the door along the groove in the door sill. Another example of improved reliability and safety is that the mounting fasteners 320 of the attachment beam 10 are parallel to the lateral force that may be exerted on an elevator door. The lateral force is sometimes created when a person or an object leans, presses or hits against the doors while either waiting for en elevator in the corridor or riding inside the elevator cab. Greater resistance to lateral motion is achieved by having some of the fastening be parallel to the lateral force, such as by fasteners 320 located on the vertical piece 20, while other fastening is perpendicular to the lateral force, such as when the longitudinal motion is induced by the presence of the guide carrier 190 and the door sill groove 330.

Presence of the reinforcement beam 120 improves support for the fasteners 320 of the guide since it contacts all sides of the fastener equally. Without it, the fasteners 320 would be inserted directly into the positioning slots 110 of the horizontal piece 60. The positioning slots 110 offer only two sides to support the fasteners, with the other sides being open to permit adjustment of the door relative to the groove 330 in the sill 340.

Additional safety is provided by the horizontal beam 240 that is mounted within the glide groove 290. This configuration reinforces the lateral strength of the glide by having the exterior walls 275 of the glide 270 prevent a lateral slippage in connection between the horizontal beam and the glide 270.

Yet another safety feature is added by having metallic safety rails 230 extend into the groove of the sill 330 alongside the glide. If the glide 270 experiences increased lateral force, it may give way and flex in the same direction as the pressure, permitting the door to move inwardly into the elevator shaft. This motion will continue until the safety rails 230 come in contact with the side of the door sill grove 330, preventing a possible glide failure and keeping the doors from swinging laterally into the elevator shaft.

One of the more innovative and essential safety enhancements of this invention is the addition of the frictional surface 90 located in places where metal surfaces of the reinforcing beam 120, the horizontal piece 60 and the top flange 200 come in contact with each other. The presence of the frictional surface 90 decreases the likelihood of slippage under pressure and interlocks the parts to prevent movement. Ideally, the frictional surface can be engraved onto the bottom surface 140 of the reinforcement beam 120, the top and bottom surfaces of the vertical piece 60, and the top surface 210 on the top flange 200 of the guide carrier 190, or in all three at the same time. The top flange of the guide carrier 190 need not have a distinct appearance from the rest of the guide, but may instead be incorporated into the shape of the guide. For example, if the guide is a solid beam, the top flange can represent the edge of the beam facing the attachment beam and having mounting holes for fasteners, but need not have a shape different from the rest of the beam.

Increasing the contact area between the metal components with frictional surfaces 90 may decrease the need for some of the components. Meaning, there may not be a need to have a separate reinforcement beam 120. In such a case the top surface 210 of the top flange 200 and the bottom surface 80 of the horizontal piece 60 will need to contain serrations engraved over the entire contact area. Serrations need not be grooves however. Any substantially rough but even surface will have a similar, slippage resistant effect.

Although this invention has been described with a certain degree of particularity, it is to be understood that the present disclosure has been made only by way of illustration and that numerous changes in the details of construction and arrangement of parts may be resorted to without departing from the spirit and the scope of the invention.

I claim:

1. An elevator door guide, comprising:

an attachment beam, suitable for attaching the elevator guide to an elevator door, the attachment beam having a horizontal piece, the horizontal piece having a length, a width, a top surface, a bottom surface, and multiple positioning slots that extend substantially across the width of the horizontal piece;

a reinforcing beam being disposed against and extending substantially along the length of the top surface of the horizontal piece of the attachment beam; and a guide carrier being disposed against the bottom surface of the horizontal piece of the attachment beam, wherein the guide carrier can be movably located within an elevator door track and the reinforcing beam and the guide carrier can move laterally in relation to the attachment beam along the positioning slots.

2. The elevator door guide of claim 1, wherein the attachment beam is L-shaped.

3. The elevator door guide of claim 1, wherein the guide carrier is T-shaped.

4. The elevator door guide of claim 1, wherein the horizontal piece of the attachment beam has a frictional surface on the bottom surface, and the guide carrier has a top surface, and the top surface of the guide carrier has a frictional surface.

5. The elevator door guide of claim 1, wherein the horizontal piece of the attachment beam has a frictional surface on the top surface, and the reinforcing beam has a bottom surface, and the bottom surface of the reinforcing beam has a frictional surface.

6. The elevator door guide of claim 1, wherein the reinforcement beam, the attachment beam, and the guide carrier are connected with fasteners.

7. The elevator door guide of claim 3, wherein the guide carrier has a top flange and at least one metallic safety rail integral to the guide carrier and positioned below the top flange.

8. The elevator door guide of claim 7, wherein the guide carrier has at least two metallic safety rails and a nylon glide mounted to the guide carrier, below the top flange and between the two metallic safety rails.

9. An elevator door guide, comprising:

an L-shaped attachment beam, suitable for attaching the elevator door guide to an elevator door, the L-shaped attachment beam having a vertical piece and horizontal piece, and the horizontal piece having a length, a width, a top surface, a bottom surface, and multiple positioning slots that extend substantially across the width of the horizontal piece;

a T-shaped guide carrier having at least two metallic safety rails integral with the guide carrier, a nylon glide mounted to the guide carrier between the metallic safety rails, and a top surface disposed against the bottom surface of the horizontal piece, wherein the guide carrier can be movably located within an elevator track; and a reinforcing beam disposed against and extending substantially along the length of the top surface of the horizontal piece, wherein:

both the bottom surface of the horizontal piece and the top surface of the guide carrier have a frictional surface thereon, the horizontal piece of the attachment beam, the reinforcing beam, and the guide carrier can be fastened together by fasteners through the positioning slots, the reinforcing beam and the guide carrier can move laterally in relation to the attachment beam along the positioning slots.

10. The elevator door guide of claim 9, further comprising at least one positioning pin.

11. The elevator door guide of claim 9, wherein the L-shaped beam and the guide carrier are made from steel.

* * * * *